United States Patent [19]

Sakamoto

[11] Patent Number: 4,750,547

[45] Date of Patent: Jun. 14, 1988

[54] METHOD FOR CLEANING INNER SURFACES OF HEAT-TRANSFER TUBES IN A HEAT-EXCHANGER

[76] Inventor: Takao Sakamoto, 140-7 Aza Umegaoka, Yotsukura-cho, Iwaki-shi, Fukushima, Japan

[21] Appl. No.: 922,844

[22] Filed: Oct. 23, 1986

[30] Foreign Application Priority Data

Nov. 7, 1985 [JP] Japan ..... 60-248114

[51] Int. Cl.[4] ..... F28G 7/00; F28G 9/00

[52] U.S. Cl. ..... 165/84; 165/95; 122/390; 134/167 C

[58] Field of Search ..... 165/84, 95; 122/390, 122/391, 392; 134/167 C, 168 C, 175, 191

[56] References Cited

U.S. PATENT DOCUMENTS

| | | | |
|---|---|---|---|
| 3,364,983 | 1/1968 | Krinov et al. | 165/84 X |
| 3,468,517 | 9/1969 | Goodman et al. | 165/84 X |
| 4,244,749 | 1/1981 | Sachs et al. | 165/95 X |
| 4,366,003 | 12/1982 | Kozte et al. | 165/95 X |
| 4,562,885 | 1/1986 | Pausch | 165/84 |
| 4,589,898 | 5/1986 | Beaver | 165/95 X |

FOREIGN PATENT DOCUMENTS

| | | | |
|---|---|---|---|
| 2927671 | 1/1981 | Fed. Rep. of Germany | 165/84 |
| 2501357 | 9/1982 | France | 165/95 |
| 44-29929 | 12/1969 | Japan . | |
| 52-35584 | 8/1977 | Japan . | |
| 1234716 | 5/1986 | U.S.S.R. | 165/95 |

*Primary Examiner*—Ira S. Lazarus
*Assistant Examiner*—Richard R. Cole
*Attorney, Agent, or Firm*—Young & Thompson

[57] ABSTRACT

An improved method for cleaning inner surfaces of heat-transfer tubes in a heat-exchanger of a multi-tube type is disclosed, in which each of the heat-transfer tubes on its inlet end is provided with a washing head including a combination of an ejecting nozzle with an ultra-sonic generator, which washing head may eject a high pressure liquid or gas to produce a turbulent flow in the heat-transfer tubes and further generate an ultra-sonic wave against the liquid in the tubes, thereby to achieve efficient release and removal of deposit, such as scales of incrustation and rust, from the inner surfaces of the heat-transfer tubes.

1 Claim, 2 Drawing Sheets

METHOD FOR CLEANING INNER SURFACES OF HEAT-TRANSFER TUBES IN A HEAT-EXCHANGER

FIELD OF THE INVENTION

This invention relates to a method for cleaning inner surfaces of heat-transfer tubes in a heat-exchanger especially of a multi-tube type, such as a condenser in a power station, in order to clean and remove scales of an incrustation and rusts deposited on the inner surfaces of the heat-transfer tubes in case of utilizing a sea-water as a cooling water.

BACKGROUND OF THE INVENTION

It has hitherto been necessary in heat-transfer tubes of heat-exchangers to periodically eliminate scales, such as an incrustation or rusts, deposited thereon during operation and to prevent the heat-transfer tubes from their reduced performance of heat-transfer and from their corrosion.

For this purpose, heretofore, an automatic cleaning apparatus has been known, in which a cleaning brush is mounted to a receiving frame arranged at either end of each tube while a water flow into the tube is switched to reciprocate the brush therein (Japanese Patent Publication No. 44-29929). With this type of the automatic cleaning apparatus, however, there have been several disadvantages in that the forcible switching of the water flow is necessary, that an opening in the receiving frame designed for receiving the cleaning brush leads to a loss of the water flow, and that foreign substances may be deposited on the inner tube surfaces.

In another method, spongy balls are placed and floated on a heat-exchanging water and are passed through the heat-transfer tube for its cleaning. This method, however, requires a special equipment for introducing and recovering the spongy balls, resulting in a larger space for accommodating the equipment and ensuring uniform distribution of the balls. Further, operational control for determining and supplementing the loss of the balls is very troublesome. In order to solve such problems, there has been proposed a cleaning system for circulating the balls (Japanese Utility Model Publication No. 52-35584) which, however, is merely designed for providing an ideal condition for the cleaning through removal of water from the balls and refill of sufficient water for its replacement and thus cannot provide a basic solution of the problems.

Accordingly, an object of the invention is to provide a reliable and efficient method for cleaning a plurality of inner heat-transfer tube surfaces in a heat-exchanger, which may be performed automatically without disturbing its operation.

SUMMARY OF THE INVENTION

In order to achieve the above object, the invention provides a method for cleaning a multi-tube type heat-exchanger having heat-transfer tubes for flowing liquid therethrough, in which the heat-transfer tubes at their inlet ends are ejected with a liquid or gas of a higher pressure than that of the liquid in the tubes from ejection nozzles to form a turbulent flow or a mixed gas/liquid flow in the tubes, while the fluid flowing in the tubes is subjected to an ultra-sonic wave for removing the deposition from the tubes. Thus, during operation of the heat-exchanger, the cleaning of the heat-transfer tubes may be reliably accomplished without reduction of a heat-exchange efficiency. In addition, there may be achieved further advantages in that an influence on flow resistance may be substantially neglected, that a space for receiving the apparatus may be smaller, and that the system may be additionally incorporated into a working heat-exchanger.

The invention will now be illustrated for better understanding with reference to the accompanying drawings but is not limited thereto.

PREFERRED EMBODIMENTS OF THE INVENTION

Figure 1:
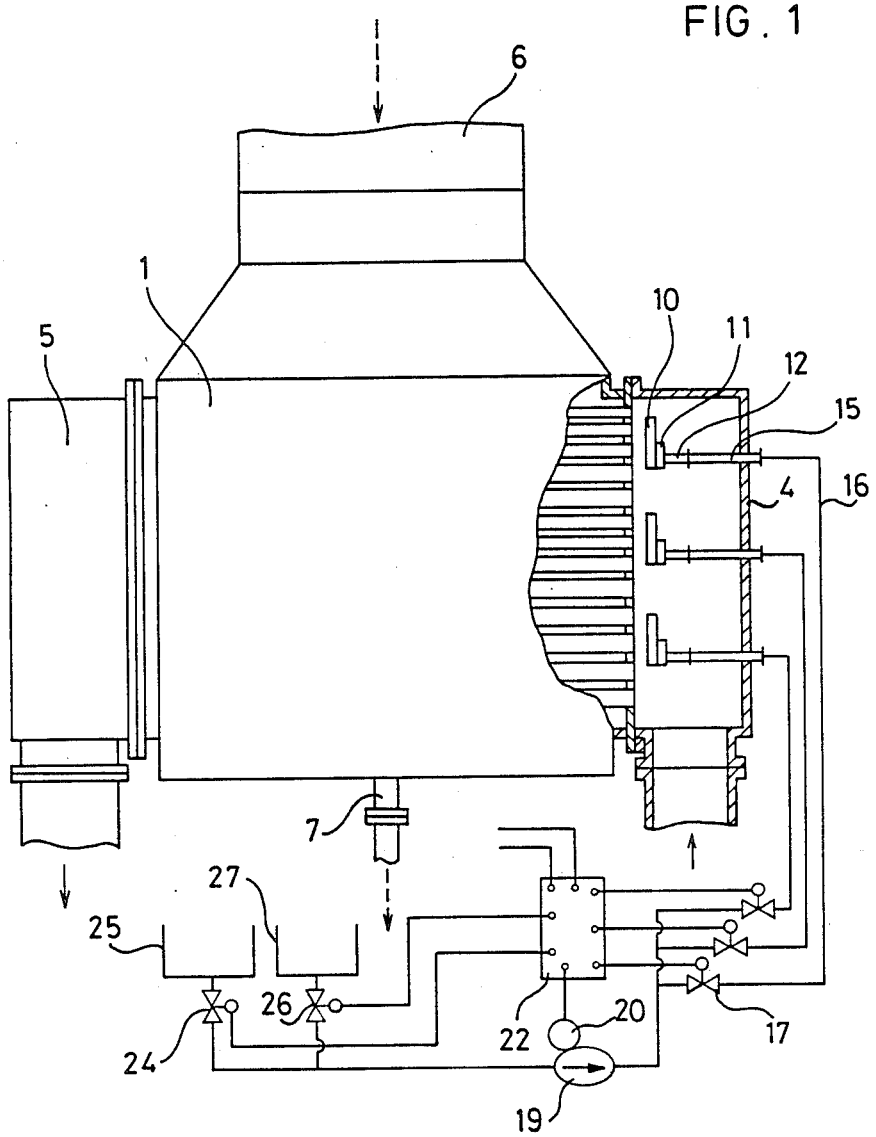
FIG. 1 is a partially broken sectional view of a main portion of a heat exchanger showing one embodiment of the cleaning method according to the invention.
Figure 2:
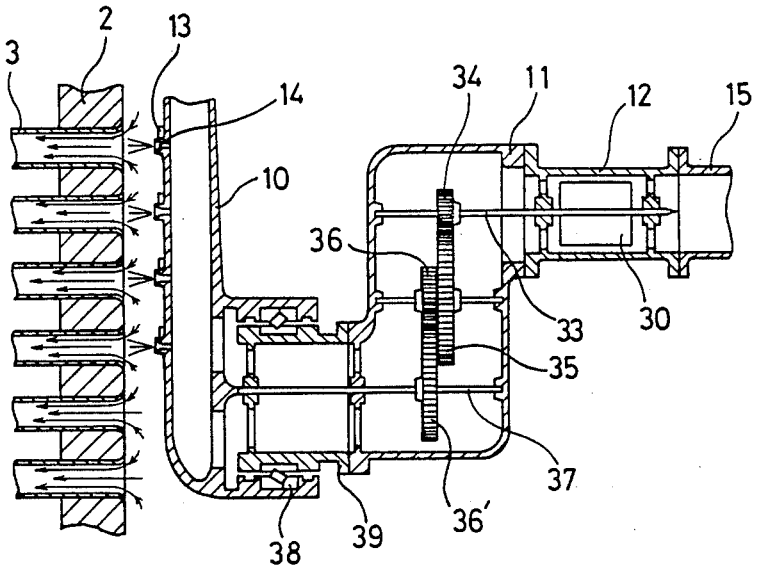
FIG. 2 is a schematic view showing construction of a cleaning head, as illustrated in FIG. 1, and its operation.

FIGS. 1 and 2 illustrate one embodiment of the method according to the invention, in which reference 1 represents a heat-exchanger, for example, in the form of a condenser arranged in a power station. Within the heat-exchanger 1 are supported a plurality of heat-transfer tubes 3 by tube plate 2, which on their inlet side are provided with a water inlet chamber 4. A cooling water introduced into the water inlet chamber 4 passes through the heat-transfer tubes 3 into a water outlet chamber 5 which is arranged on an outlet side of the heat-exchanger 1. On the other hand, the heat-exchanger 1 at its upper part is provided with a steam inlet 6, into which is introduced steam. The steam is heat-exchanged with the cooling water in the heat-transfer tubes 3 for condensation, while the condensed water is discharged from a condensed water outlet 7 which is arranged at a lower part of the heat-exchanger 1.

When scales of an incrustation and rust are deposited from the cooling water onto inner surfaces of the heat-transfer tubes 3 during operation of the heat-exchanger, a high pressure liquid is ejected from a washing head 10 into the heat-transfer tubes 3 while the flowing liquid is subjected to an ultra-sonic wave for removing the scales. The ejected liquid is pressurized by a pump 19 in order to give a higher pressure than the pressure of the cooling water in the heat-transfer tubes 3 and is fed through a supply pipe 16 to a guide tube 15 within the water inlet chamber 4. Adjacent to the guide tube 15 is arranged a turbine mantle 12 containing therein a turbine which is rotated by the flowing force of the ejected liquid and allows with its rotating force the washing head 10 to be slidable.

A plurality of the washing heads 10 may be arranged in the inlet chamber 4 depending on the number of the heat-transfer tubes 3, which may be switched by a valve 17 for sequentially selecting the tube to be cleaned and ejecting the washing water thereinto.

The sequence and duration of feeding the water into the washing head 10 may be previously inputted into a memory of an operation-controlling panel 22 for controlling a water-ejecting pump 19 through a pumping motor 20, thereby to achieve the automatic operation.

If each heat-transfer tube 3 is made of a brass material and the cooling water is sea-water, a trace amount of iron is required to be injected for protecting the inner surface of the heat-transfer tube 3. For this purpose, a solution added with an iron ion is stored in vessels 25, 27 and may be ejected from the washing head 10. Depending on the nature and type of the deposit on the inner surface of the heat-transfer tubes 3, the ejecting liquid may contain a surfactant or a chloride ion and may be stored in the vessel 25, 27 for its ejection from the washing head 10.

FIG. 2 shows the operation of the washing head 10. The ejecting liquid introduced through the guide tube 15 is rotates the turbine in the turbine mantle 12. The rotation of the turbine 30 is transmitted to a main shaft 33 and then to reduction gears 34, 35, 36 and 36' in a reducer casing 11. The washing head 10 directly connected to a rotary shaft 37 is rotated by the rotary shaft 37 and ejects the liquid from the ejecting nozzles 14 sequentially into the heat-transfer tubes 3.

Figure 3:
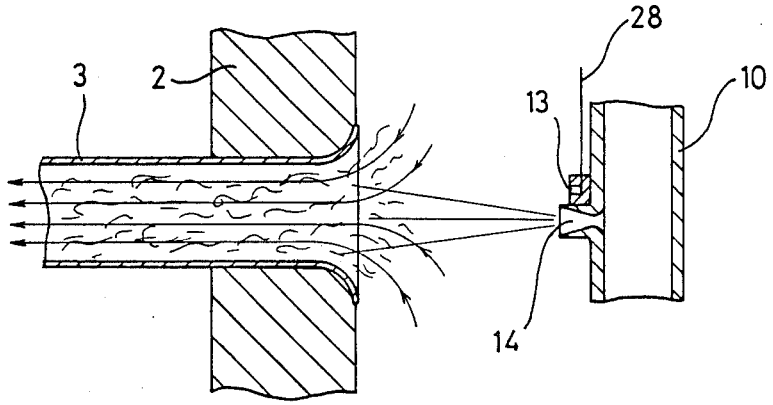
FIG. 3 is a sectional view of an injection nozzle and a heat-transfer tube, as shown in FIG. 1.

FIG. 3 illustrates the ejecting nozzle 14 on an enlarged scale. The ejected liquid from the nozzle 14 may be turbulent in the heat-transfer tube 3 advantageously for releasing and removing the deposit from the tube 3. In order to further improve the releasing and removing efficiency, the turbulent flow of the liquid is subjected to an ultra-sonic wave generated from an ultra-sonic generator 13.

The ultra-sonic wave may be generated by energizing the ultra-sonic generator 13 by means of a signal supplied from an ultra-sonic controlling apparatus through a signal line 28. The controlling apparatus may be placed externally of the heat-exchanger or incorporated in the controlling panel 22 for association with the ejecting pump 19 and the switching valves 17, 24 and 26.

In accordance with the invention utilizing the flow movement of the cooling water in the heat-transfer tubes, the inner surfaces of the tubes may be cleaned during operation with neither reduction of the heat-transfer performance nor increase of the water resistance in the cooling water system. Further, the space for receiving the apparatus may be substantially reduced, so that its addition to the existing plant may be practically possible during actual operation.

In particular, the ejection of the high pressure liquid into the heat-transfer tubes may cause a violent and turbulent flow therein to facilitate the release of the deposit, while the ultra-sonic wave generated against the turbulent flow in the tubes may cause the cavitation phenomenon to enlarge the turbulence, thereby to facilitate the release of the scale from the tubes. Further, the rotation of the washing head by the flowing force of the ejected liquid may avoid utilization of external power, and a small quantity of the liquid added may have a significant effect for removal of special soilings and for protection of the inner surfaces of the tubes.

What is claimed is:

1. A method for cleaning inner surfaces of heat-transfer tubes in a heat exchanger of a multi-tube type having a liquid flowing therethrough, comprising ejecting a high pressure liquid into inlet ends of the heat-transfer tubes whereby liquid flows through the heat-transfer tubes with turbulent flow, generating an ultrasonic wave against the flowing liquid in the tubes, and providing in communication with said inlet ends of the heat-transfer tubes an inlet chamber containing a plurality of washing heads each comprising a combination of a liquid-ejecting nozzle and an ultrasonic generator, the washing heads being mounted for rotation in said inlet chamber, and applying the kinetic energy of said high pressure liquid to a turbine that rotates said washing heads.

* * * * *